United States Patent [19]

Vespasiani

[11] 4,437,297

[45] Mar. 20, 1984

[54] APPARATUS FOR PRODUCING METALLIC CORDS IN LAYERS

[75] Inventor: Alberto Vespasiani, Milan, Italy

[73] Assignee: Societa' Pneumatici Pirelli S.p.A., Milan, Italy

[21] Appl. No.: 351,367

[22] Filed: Feb. 23, 1982

[30] Foreign Application Priority Data

Feb. 26, 1981 [IT] Italy ..... 19994 A/81

[51] Int. Cl.[3] ..... D07B 3/04; D07B 3/12; D07B 7/02

[52] U.S. Cl. ..... 57/9; 57/58.32; 57/58.55

[58] Field of Search ..... 57/6, 9, 3, 58.55, 314, 57/58.52, 311, 58.3, 58.32

[56] References Cited

U.S. PATENT DOCUMENTS

| | | | |
|---|---|---|---|
| 3,309,857 | 3/1967 | Haugwitz | 57/58.52 |
| 4,195,469 | 4/1980 | Tarantola | 57/311 |
| 4,300,339 | 11/1981 | Orlandi et al. | 57/58.55 X |
| 4,335,571 | 6/1982 | Tarantola | 57/311 X |

FOREIGN PATENT DOCUMENTS 2044314 10/1980 United Kingdom .

*Primary Examiner*—John Petrakes

*Attorney, Agent, or Firm*—Stevens, Davis, Miller & Mosher

[57] ABSTRACT

Apparatus for producing metallic cords having layers of wires twisted around a wire core, with great efficiency and low costs, of the outer collection kind, comprises two double-twist cabling machines in series, mutually co-axial and joined together in such a way that the ratio of the rotational velocities of two cages differ and can be changed while the apparatus is in operation.

10 Claims, 4 Drawing Figures

120°
120°

APPARATUS FOR PRODUCING METALLIC CORDS IN LAYERS

This invention relates generally to metallic cords, and more particularly to cords of the kind used for strengthening elastomeric articles such as vehicle tires, tapes, belts, and the like and to apparatus for making the cords.

In particular, the invention relates to the manufacture of metallic cords having a central wire core and a crown constituted by one or more layers of wires which are co-axial with the core and helically wound or cabled on it.

By the word "wires" as used herein, is meant both single metallic wires, better defined as elementary wires, and strands, i.e. cords, of a plurality of elementary wires twisted together.

One very advantageous method for producing such metallic cords is very well known. This method produces a strand by winding a number of wires which is equal to the number of wires to be in the crown layer about a central wire cord and, therefore, twists the strand to transform it into a sheaf of different wires and then twists the sheaf of wires helically on the core to be covered with the layer of elementary wires.

The method is conveniently practical with two double-twist cabling machines, in series, which are preferably co-axial to each other and are connected in such a way that the first machine rotates at one-half of the velocity and in the same direction as the second machine.

For example, in an outer collection plant of recent kind, the feeding bobbins of the wires to form the crown layer are arranged in the cage of the slower of the cabling machines. The feeding bobbin of the already formed portion of cord to be wound into the new layer is arranged on the faster cabling machine.

In practicing the disclosed method, the wires are delivered by the bobbins arranged on the cage of the slower cabling machine, are directed to the outside of the cabling machine and led from end to end thereof according to the known development of the double-twist machine so as to cable the wires in a strand which is double-twisted at the point where it is leaving the slow machine.

Then, when the strand passes to the fast cabling machine, the wire is led, as already known, from end to end of the faster cabling machine but, because of the direction and velocity of rotation of the faster machine with respect to the slower one, the strand is first completely untwisted to produce a sheaf of different wires, which are once again twisted together before leaving the faster cabling machine but, at the same time, they are wound helically and mutually parallel on the central portion of the cord (core), in the meantime delivered and led to the same end of the faster cabling machine.

It has, been noted that this working process reaches a very technical progress. As a matter of fact, with old prior art apparatuses (for example with the inner collection type machines) it was not at all applicable whereas with the most recent apparatuses production is increased with cost reduction in respect of the other modern available machines. The quality of the finished cord, however, is not entirely satisfactory because of irregular points in the distribution of wires in the crown layers, with variation in pitch, separation of a wire from the surface of the wire layer and variation in lengths of wires of the same layer in a given portion of the cord.

These disadvantages are not distributed on the whole cord but the irregularities frequently occur in the first portion of the cord produced after a temporary shutdown for feeding wire bobbins to the apparatus.

During these transient states, wires of the first group, i.e. in those of the crown layer may break.

It has now been discovered that it is possible to avoid these problems and to improve the quality and regularity of the cord while still maintaining the economical advantages of the simple production method of the prior art.

An object of the present invention is to provide an apparatus for producing cords in layers with the double-twist system, by a simple process at a high production rate which are of high-quality with a high degree of regularity and uniformity of geometrical configuration.

Another object of the invention is to provide an improved apparatus for cabling wires about a core of one or more longitudinally extending wires to form a cable having a core surrounded by a crown of wires twisted thereabout. A still further object of the invention is to provide an improved cord of twisted wires adapted for reinforcing elastomeric articles such as vehicle tires, conveyor or power transmission belts and the like.

Other objects will become apparent from the following description with reference to the accompanying drawing wherein FIG. 1 is a diagrammatic illustration of one embodiment of apparatus provided by the invention;

Figures 1, 2, 3, 4:
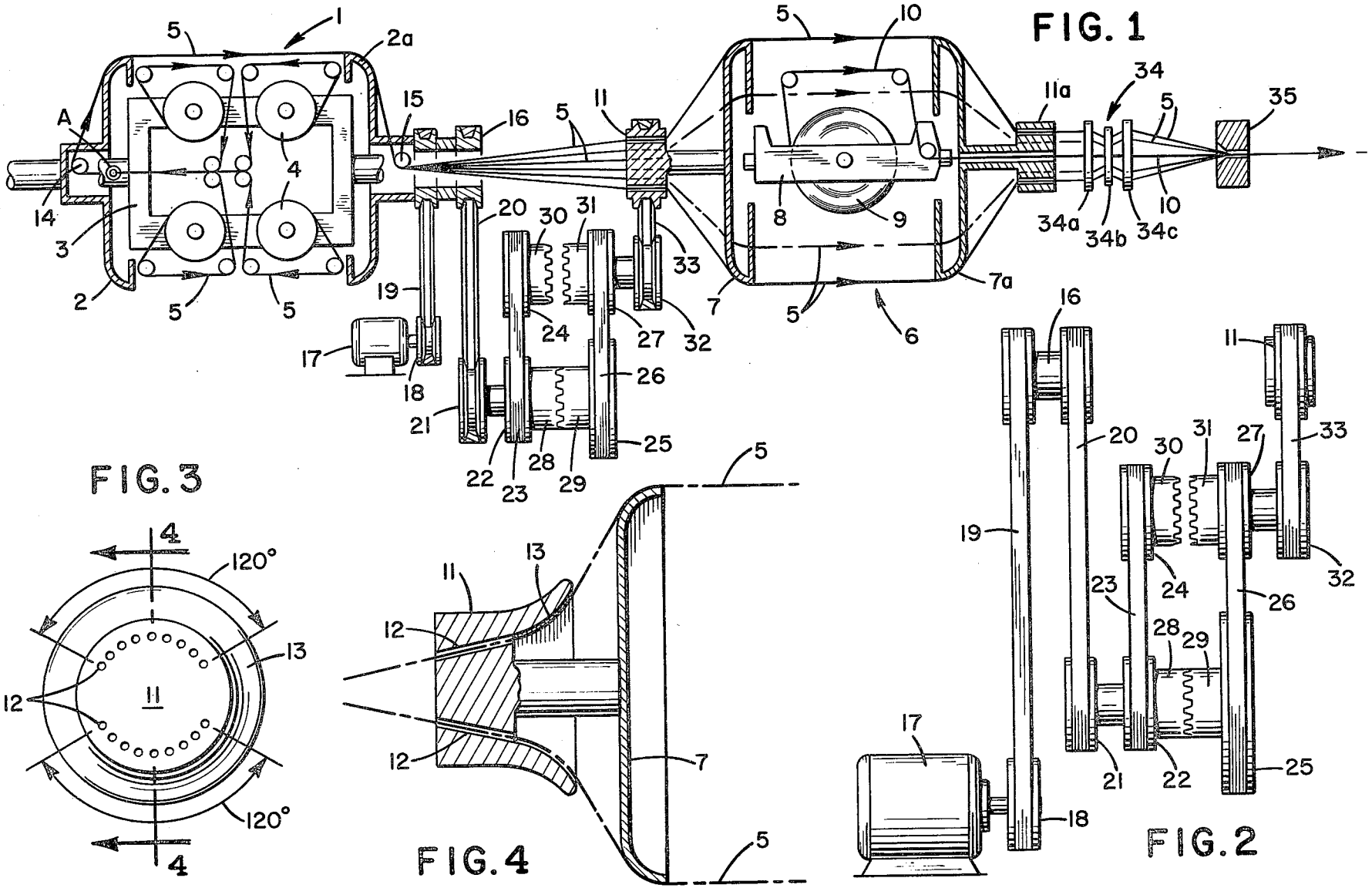
FIG. 2 is an enlarged diagrammatic elevation of the coupling device of the embodiment of the apparatus illustrated in FIG. 1.
FIG. 3 is a front or end view of a drum for spacing wires.
FIG. 4 is a section taken along the plane 4—4 of FIG. 3.

The foregoing objects and others are accomplished in accordance with the invention, generally speaking, by providing an apparatus for producing metallic cords adapted for reinforcing elastomeric structures, having a central core and at least one crown layer, the wires of each crown layer being mutually helical and parallel and wound on the radially innermost layer and on the central core, the apparatus comprising a first double-twist machine consisting essentially of a cage rotatable around its own axis and by a cradle which is co-axial to the cage, placed inside the cage, freely rotating around its own axis and able to support delivery bobbins of a first group of wires for forming the crown layers of the cord, a second machine which is substantially equal to the first machine and delivers a second group of wires being the central portion or core on which a crown layer is wound, a preforming device adapted to permanently deform, such as by bending, the wires of the first group and a device for reciprocally coupling of the first and second machine adapted to maintain during operation a steady ratio of 1:2 between the rotation velocities of the relative cages, the apparatus being characterized by the fact that the coupling device permits variation of the ratio between the rotation velocity of the two cages from 1:1 during the transient starting-off to 1:2 during operation, the second machine comprising means adapted to maintain the wires of the first group, during their passage from end to end of the second machine, externally of the relative cage and each according to a generatrix of the corresponding surface of rotation, mutually spaced and comprised in at least one circumferential portion of the surface of rotation.

According to one advantageous embodiment of the apparatus, the coupling joint between the first and second machines comprises two elements rigidly connected to each other for driving the motion from one cage to the other with a predetermined ratio between velocities of the cages, the connecting elements being alternatively activated, the reciprocal commutation being only by means of a preventive complete decoupling between the two cages.

The means for spacing the wires of the first group comprise, for each end of the cage, a cylindrical drum which is co-axial to and fast with the cage, provided with a plurality of conduits in a substantially axial direction, circumferentially and concentrically distributed with respect to the axis of the drum, preferably uniformly arranged in two circumferential areas not wider than 120°, symmetrically arranged with respect to a diameter. Moreover, the conduits can be inclined with respect to the axis of the drum, all in the same direction each in the axial plane in which it is embedded, axially convergent to the outside of the drum with respect to the corresponding cage.

One of the drums, i.e. the one present at the outlet of the cage, with reference to the direction of the wires on the machines, can very advantageously constitute the preforming device for the wires of the first group; the drums are, moreover, advantageously provided on the end turned towards the corresponding cage with a substantially truncated-conical sleeve internally funnel flared and opened towards the cage so as to constitute a surface for accompanying the wires of the first group.

Referring now to FIG. 1, the apparatus comprises a first machine, which will be called "the slower machine," of double-twist type, consisting essentially of a cage, which eventually reduces to two mutually co-axial and rotating discs 2 and 2*a*.

Between discs 2 and 2*a*, a cradle 3 is disposed which supports bobbins 4 for delivering the first group of metallic wires 5; said wires, by means of a certain number of return rollers, among which in particular rollers 14 and 15, are axially taken out of the cage, and therefore wound on it and removed by it again with axial trajectory.

The cradle is arranged co-axially to the cage and freely rotates with respect to the latter so that while the cage is rotating the cradle is stationary.

Also the bobbins are all freely rotating around their own axis, every axis being in agreement with the cradle, so as to allow the regular unwinding of the wires 5 during the working process.

The number of bobbins 4 depends on the number of wires required to form the crown layer by winding on the preformed core of the cord; in particular with bobbins which deliver only one wire, the number of bobbins 4 is equal to the number of wires of the crown layer.

A second machine 6 of double-twist type which will be called the faster of the two machines is coupled to machine 1. The faster machine is substantially like the previous one, i.e. it comprises a cage having two discs 7 and 7*a* mutually co-axial and rotating and a cradle 8 which supports a feeding bobbin 9 of the group of wires 10 for forming the central portion of the cord which must be wound into the new crown layer.

The second group of wires 10, by means of a series of return rollers, is led outside the cage and immediately removed from there along a trajectory coincident to the axis of the machine.

Associated with discs 7 and 7*a* of the cage, and in an axially outer position with respect to them, two drums 11 and 11*a* are arranged co-axially to the discs.

Drums 11 and 11*a* are provided with a plurality of holes 12, FIGS. 3 and 4, substantially axial and circumferentially arranged co-axially to drums 11 and 11*a*.

Holes 12 can be distributed uniformly on the whole circumference or assembled in one or more circumferential areas; for example, FIG. 3 shows drum 11 with eighteen holes 12 which are grouped in groups of nine in each part, in two circumferential areas each with a width equal to 120°, symmetrically arranged with respect to a diameter.

The advantage of such a distribution in groups will become apparent hereinafter.

Holes 12 are directed in an axial sense, as shown in FIG. 1, or variably inclined with respect to the drum axis, for example, distributed according to a conical surface as in FIG. 4.

Drums 11 and 11*a* can be provided also, on their face turned towards the corresponding disc of the cage, with a sleeve 13, internally funnel flared and open towards the disc, to guide the trajectory of each wire 5 from the drum to the outermost radial surface of the cage disc as shown in FIG. 4, and vice versa, in the case of drum 11*a*.

The two machines 1 and 6 are connected to each other by a coupling device, which will be simply called "coupler" for settling two different ratios between the rotational velocities of the two cages and precisely the ratio 1:1 (equality ratio) and 1:2.

FIG. 2 shows an advantageous embodiment of the coupler being substantially constituted by pairs of elements rigidly connected to each other by direct coupling, for driving each coupler at its own velocity ratio, connected by belts and pulleys on one side with the outlet sleeve 16 of the first cage and on the other side with the inlet drum 11 of the second cage.

Upon examining the device in detail, it is seen that sleeve 16 of the slower cage is moved directly by motor 17 through pulley 18 and belt 19 and drives pulley 21 through belt 20.

On the axis of pulley 21 is secured the first pair of connecting elements constituted by two pulleys 22 and 25 fixed to upstanding flanges 28 and 29, respectively, which are toothed in the radial direction on the surfaces turned to the facing flange and serve as a clutch.

Pulley 22 is assocaited with pulley 21 and it is connected by belt 23 to another pulley 24.

It is therefore obvious that pulleys 22 and 24 are driven directly by motor 17.

On the axis of pulley 24 is secured the second pair of toothed coupling elements 30, 31 secured to pulleys 24 and 27, respectively, forming a second clutch similar to the first clutch previously described.

Pulley 27 is associated with another co-axial pulley 32 and it is connected by belt 26 to pulley 25.

In its turn pulley 32 is connected by belt 33 to the inlet drum 11 of the "fast" cage 6.

The two pulleys 22/25 and 24/27 of each pair are associated with each other, by direct coupling with a relative axial motion, through the corresponding toothed members, but the two pairs cannot be simultaneously connected; indeed, the driving device (not shown) closes one coupling with the other is open and vise versa.

The operation of the coupler should be easily understood. Depending on which of the pulleys is in direct drive, the rotation motion of sleeve 16 is transferred to the drum 11 through pulleys 22/25 or, in the alternative, through pulleys 24/27; the drive is entirely developed in such a way that through pulleys 24/27 the rotation velocities of the two cages are alike (ratio 1:1), when the drive presses through pulleys 22/25 the velocity of drum 11 is twice that of the sleeve 16 and has the same rotational direction.

The 1:2 ratio is easily obtained by increasing the diameter of pulley 25 with respect to pulley 27.

As already mentioned, during the transient starting-off, cages 1 and 6 are rotating at the same speed because pulleys 24/27 are mutually connected while during operation pulleys 22/25 are connected so that cage 6 is rotating twice as fast as cage 1 which is why the two machines have been described as "slow" and "fast" machines.

The apparatus is, moreover, provided with a performing device 34 which can be very advantageously constituted by three co-axial adjacent discs, each having a plurality of holes circumferentially distributed around the periphery, through which the wires of the first group are led before they are wound on the central portion 10 of the cord.

The disc **34*b* arranged in the central position can be rotated with respect to the two adjacent discs so that the passing wires are subjected to an abrupt angular variation in trajectory so that they are permanently preformed by bending: the degree of abruptness of change of direction is depending upon the extent of the rotation of the disc 34*b* with respect to the two adjacent outside discs 34*a* and 34*c***.

Downstream of the above-described performing device (according to the direction of the wire advance) there is finally a stranding head 35 which gathers the wires 5 and fixes the point where the wires are helically wound about the central groups of wires 10 to form the cord.

This head, disconnected from the two cages, is fixed on the casing of the machine and has a gauged hole with a diameter equal to the one of the collected cord and is flared outwardly from the point the cord enters.

In this way, the head prevents reciprocal sliding of the winding points of each wire with the following overlapping among the wires of the crown layer with all the known following defects in the finished cords.

The apparatus also includes a series of well known devices, here not shown, for stretching and collecting the produced cord, as well as the well known capstan.

The operation of the apparatus is described with respect to the aspects related only to the invention since the operation is, in general, easily understandable on the basis of the previous explanation.

As already mentioned, the cords in the layer produced by the prior art machine had some qualitative imperfections with an apparently random distribution which was therefore difficult to control.

It was believed that these defects could depend on the fact that the wires of the crown layer reached the winding point grouped in bundles and therefore with reciprocal overlappings.

This hypothesis, however, does not explain the absence of defects in the tracts of regular cord or the accumulation of defects in particular tracts of cord and particularly in those appearing after the starting of the apparatus.

In examining in full detail this particular moment of the working process, it is asumed that the known apparatus is started after providing it with the necessary bobbins 4 and 9 in order to produce a desired kind of cord.

At this point what must be noted is that, the various wires 5 have been manually drawn through the apparatus up to winding them on the collecting device placed downstream of the fast machine.

Consequently, a sheaf of different wires, instead of a strand, runs through the whole apparatus from the bobbins of the slow machine to the collecting device.

Attention must be paid to the fact that in the apparatus of the invention, the element for entering machine 6 is drum 11 while in the prior known apparatus the drum is replaced by a return roller.

If now the apparatus is started, the sheaf of wires 5, in the tract on the cage of the slow machine is not subjected to any twist but remains in the sheaf state as soon as it passes on the out let roller of said cage.

In other words, said outlet roller delivers during the transient starting, a sheaf of wires of the same length as the length of the trajectory on the slow cage, instead a strand, as during exercise.

Remembering now that fast cage rotates at a velocity which is double the velocity of slow cage, it is seen that the sheaf of wires passing on fast cage cables into a strand and in the opposite direction with respect to the expected one and in that state it goes through the fast machine and is helically wound on the portions of the cord being delivered meanwhile by bobbin on said fast machine.

The apparatus returns to the regular exercise as soon as the point beginning of the strand forming on the slow cage (see point A in our FIG. 1) arrives at the winding point with the core.

It should now be apparent that using the coupler at two velocity ratios according to the invention, allowing the two cages to rotate at the same velocity during the initial transient and until point A of the sheaf of wires 5 has passed roller 15, formation of a strand on the fast cage is avoided and thus the greatest number of qualitative defects in the crown layers of the pior art cords are eliminated.

Moreover, the length of the sheaf between rollers 14 and 15 is determined by the characteristics of the apparatus so that by knowing the advance velocity of the sheaf and the rotational velocity of the cage, the length is directly correlated to an exact number of revolutions of the cages; it is then possible, and it happens in the apparatus of the invention, to automatically change the operation of the coupler from a ratio of 1:1 to a ratio 1:2 after a predetermined number of revolutions has been carried out or a predetermined length of strand delivered.

The above-mentioned drawbacks are present any time a bobbin 4 is changed and the nature of the relative defects on the cord varies depending upon the number of bobbins changed and, therefore, the number of wires fed to the apparatus.

Together with the coupler and in order to eliminate also the remaining less important qualitative defects, the two spacing drums 11 and **11*a*** are supplied.

It has, in fact, been noted that the wires 5 of the strand coming from machine 1, returning to the sheaf state to machine 6, maintain an individual twist which makes them rotate on themselves, in a limited but non-neglectable way, around their axes.

This phenomenon depends on the fact that the twists caused by the wires when they are helically arranged to form the crown layer of the developing cord climb up the wires again passing drum 11*a* or the corresponding prior art roller, coming to the portion of wire running on the cage.

This twist causes incorrect stranding, i.e. reciprocal weaving of the wires of the sheaf, which weaving is not eliminated by helical winding of the wires on the central portion of the cord, transferring to the crown layer the above mentioned qualitative defects. In the apparatus of the invention, the drum 11, receiving the un-twisted strand, distributes on the contrary the wires 5 circumferentially on the outer surface of cage 6, according to trajectories coincident to the generatrices of the cylindrical surface of rotation determined by the coupling of discs 7 and 7*a* of the cage, allowing moreover each wire to freely rotate on itself, as already explained.

This arrangement is maintained also by the following drum 11*a* and by the preformer 34 so that when the wire is helically wound, the wires 5 are arranged substantially concentric to the core 10, thus producing, also by the useful intervention of the stranding head 35, an exact, balanced and uniform arrangement in the crown layer.

By means of the spacing drums of the alternative embodiment shown in FIG. 3, the wires 5 are arranged in groups in two circumferential arcs and with a 120° width.

The advantage of this arrangement is easily understood when thinking of the necessity of periodically replacing bobbin 9 on the cradle 8.

In fact, such an arrangement of wires 5 frees a 60° arc, on two side of the surface of the cage, this arc provides sufficient space given the diameter of the discs 7, 7*a* for removing or inserting a bobbin 9 without affecting the wires 5, stretched on the cage.

It is also to be observed that both the variable ratio coupling and wire spacing drums 11, 11*a* are necessary in order to achieve the object of the invention. An apparatus with only a variable speed coupler would not eliminate the imperfections caused by incorrectly wound strands, which are caused by reciprocal overlapping of the wires 5, grouped as a sheaf on cage 6.

On the contrary an apparatus with spacing drums but without the variable speed coupler would not even operate: suffice it remember the fact that, like with a prior art apparatus, during the transient starting-up phase a twisted strand would arrive at the fast machine and not a sheaf of different wires.

It is now clear that drum 11 with its spaced holes prevents the passing of a strand, so that there would inevitably be the breakage of the wires 5 at any start-off.

Finally, it is to be pointed out that drum 11*a*, apart from the possible difficulties of practical problems, could be replaced by preformer 34, which also carries out circumferential spacing of the wires coming from the cage, as it is shown in FIG. 1. As concerns the possible substitution, only one of the discs of preformer 34, could serve as preformer and drum 11*a* on condition that, of course, the trajectory angle of the wires through the disc were such as to give the wire the necessary preformation.

Moreover, with certain types of cords, for example the wrapped ones, this preformation by device 34 could be omitted, since the twist received by the wires in the passage through the apparatus would be sufficient to maintain the wires assembled together in the finished cord. In such cases, the circumferential spacing of the wires would be sufficient to obtain high qualitative cords.

In last analysis, it is to be observed that the described apparatus produces metallic cords which can be recognized as cords produced on the described apparatus instead on the alternative apparatus of the prior art.

In fact, in the cords produced by machines which dispose the wires of the crown layer helically wound on the central portion of cord because of a bending preformation which develops on their outer surface as a cylindrical helix, the single wire, at the end of the process, is not subjected to any twist on itself.

It follows that the generatrices of each wire, the latter being considered a cylinder, are parallel to the axis of the wire.

On the contrary, in the cords produced by the apparatus according to the invention, the wires of the crown layer are subjected to bending preformation substantially developed according to a generatrix (apart from the modest, and to this aim without any importance, rotation on itself to which each wire is subjected on the surface of the faster cage) but on winding on the central portion of the cord they too are subjected to a rotating motion around their own axis arranging the generatrices of each wire according to a cylindrical helix.

The above-mentioned possible recognition arises from the fact that the hypothesis of a perfectly cylindrical wire is not true also if it is surely suitable as concerns the behavior of the wire in practice.

As a matter of fact, the metallic wire, because of the processings experienced, is generally of elliptical section, or better, rather irregular and often with some tracts of the periphery of its straight section which is somewhat rectilinear.

This allows detection with a suitable test, for example microscopical, of at least one generatrix and, consequently, its arrangement in the wire of the finished cord, and its rectilinear or helical development, and it is therefore possible to recognize if the wire has been subjected to a twist around its own axis.

Practically, in the finished cord the wires of the crown layers have a complete twist around its own axis for every length of pitch.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. An apparatus for producing metallic cords for reinforcing elastomeric structures, comprising a central core and at least one crown layer, the wires of each crown layer being mutually helical and parallel and wound on the layer radially inwardly therefrom and on the central core, said apparatus comprising first and second double-twist type machines disposed in tandem, each of said machines consisting essentially of a cage rotatable around its own axis and of a cradle which is disposed in the cage and co-axial therewith, and freely rotatable around its own axis, the first cradle being adapted to support delivery bobbin or bobbins of a first group of wires for forming said crown layer, the second cradle being adapted to support delivery bobbin or bobbins of a second group of wires for forming a central core on which a crown layer of wires is to be wound, said apparatus comprising also a preforming device adapted to deform permanently be bending the wires of said first group and a device reciprocally coupling said first and second machine which is adapted to maintain during operation a constant ratio of 1:2 between the rotation velocities of the first and second cages, said apparatus being characterized by the fact that said coupling device allows variation of said ratio between the rotational velocity of the first and second cages from 1:1 during the transient starting to 1:2 during operation, guiding means being also provided on the second machine for the wires of said first group, disposed externally of the cage, on both its extremities, and fastened with the same and oriented coplanarly to the rotation axis of said second cage.

2. The apparatus of claim 1 characterized by the fact that said coupling device comprises two pairs of elements rigidly connected to each second one for transferring motion from the first cage to the other at a predetermined ratio between the velocities of said cages, said elements being alternatively in operation.

3. The apparatus of claim 2 characterized by the fact that said two pairs of elements are mutually commutable by complete decoupling of the first and second cages.

4. The apparatus of claim 1 characterized by the fact that said guiding means comprise for each extremity of the cage a cylindrical drum, co-axial to and fast with said cage, provided with a plurality of conduits, in a substantially axial direction, circumferentially and concentrically distributed with respect to the axis of said drum.

5. The apparatus of claim 4 characterized by the fact that said conduits are uniformly distributed in two circumferential arcs symmetrically arranged with respect to a diameter, said arcs having an aperture which is not wider than 120°.

6. The apparatus according to claim 4 characterized by the fact that said conduits are inclined with respect to the axis of said drum all in the same direction, each in the axial plane in which it is embedded axially convergent to the outside of said drum with respect to the cage.

7. The apparatus according to claim 4 characterized by the fact that the drum placed at the outlet end of the cage, with reference to the direction of motion of said wires on said second machine, constitutes said preforming device for said first group of wires.

8. The apparatus according to claim 4 characterized by the fact that the drum is provided, on the end facing said cage, with a substantially conical-truncated sleeve, internally flared outwardly and open towards the corresponding cage, according to a shape corresponding to the path of the wires of said first group passing from said drum to said cage.

9. An apparatus for making a wire strand which has a longitudinally extending wire core and at least one crown layer of wires helically wound around the said wire core, said apparatus comprising first and second cages which are idependently rotatable around their own axes and are disposed in tandem, and means linking together the rotation of the first and second cages which are adapted to change the rotation of said cages from the same to different rotational speeds, in the ratio 1:2, each of said cages comprising longitudinally spaced co-axial discs and a cradle disposed co-axially between the discs and rotatble relative to the discs, a bobbin of each wire to be incorporated in said crown layer which is supported rotatable about its axis on said cradle between the discs of the first cage, means comprising rollers on said discs of the first cage for guiding wires from the bobbins externally of the cradle from disc to disc of the first cage to wind said wires on the cage and remove them axially therefrom, means for guiding wires emerging from the first cage as a sheaf to the second cage comprising a first drum upstream of the second cage, and a second drum downstream of the second cage for guiding the wires emerging from the second cage, means for deforming the wires associated with the downstream end of the second cage and said second drum for maintaining the arrangement of wires in a sheaf and directing the sheaf axially therefrom, and a stranding means for winding said wires emerging from the second drums about said core.

10. In an apparatus for winding a plurality of wires helically about a wire core to form crown layers of twisted wires, said apparatus comprising first and second cages disposed in tandem, means disposed between the cages for rotating the two cages about their axes at the same or different rotational speeds, in the ratio 1:2, comprising motor means having a driven shaft, a first pulley fastened to said shaft for rotation therewith, a pair of second and third pulleys connected for mutual rotation spaced from the first pulley and associated with a first cage of said apparatus for rotation thereof, an endless belt looped around said first and second pulleys for transfer of motion therebetween, a second endless belt looped around said third pulley and a fourth pulley spaced from the third pulley, a first pair of pulleys having toothed annular flanges upstanding therefrom and meshing with each other for simultaneous rotation to form a clutch and associated with the fourth pulley for rotation therewith, and a second pair of pulleys having upstanding meshing toothed flanges forming a clutch and spaced from said first pair connected by endless belts with said first pair of pulleys, and means connecting said second pair of pulleys to said second cage for rotation of the second cage around its longitudinal axis at a speed different from the rotation of the first cage.

* * * * *